US009480866B2

(12) United States Patent
Pollard

(10) Patent No.: US 9,480,866 B2
(45) Date of Patent: Nov. 1, 2016

(54) LINE CONNECTOR HAVING A LINK DETECTION SYSTEM AND METHOD OF MAKING SAME

(71) Applicant: THE BOEING COMPANY, Huntington Beach, CA (US)

(72) Inventor: Gerald Oren Pollard, Snohomish, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 14/519,266

(22) Filed: Oct. 21, 2014

(65) Prior Publication Data

US 2016/0107007 A1 Apr. 21, 2016

(51) Int. Cl.
*A62B 35/00* (2006.01)

(52) U.S. Cl.
CPC ..... *A62B 35/0075* (2013.01)

(58) Field of Classification Search
CPC ..... A62B 35/0075; A62B 35/0006; A62B 35/0068; A62B 35/0043; A62B 35/0087; A62B 35/0037; A62B 35/00; A62B 35/005; A62B 35/0056
See application file for complete search history.

(56) References Cited

U.S. PATENT DOCUMENTS 3,777,180 A * 12/1973 Carlson ..... B60R 22/48 327/3
5,883,441 A * 3/1999 Shoemaker ..... B60R 22/48 307/10.1
6,265,983 B1 * 7/2001 Baillargeon ..... A62B 35/0037 340/673
6,330,931 B1 12/2001 Baillargeon et al.
6,868,941 B1 * 3/2005 Hermann ..... A62B 35/0037 182/18
6,894,621 B2 * 5/2005 Shaw ..... B66C 13/44 212/276
7,636,990 B1 * 12/2009 Choate ..... F16B 45/02 24/600.1
8,325,053 B2 12/2012 Flynt et al.
9,149,670 B1 * 10/2015 Walker ..... A62B 35/0068
2004/0255580 A1 * 12/2004 Bayerl ..... B64C 11/303 60/602
2005/0045345 A1 * 3/2005 Arvidson ..... A62C 5/02 169/14
2006/0219875 A1 * 10/2006 Yamada ..... G01S 7/4811 250/221
2009/0249712 A1 * 10/2009 Brickell ..... A62B 1/10 52/173.1
2010/0194893 A1 * 8/2010 Graeser ..... A62C 3/0271 348/159
2010/0231402 A1 * 9/2010 Flynt ..... G08B 19/00 340/679
2011/0042984 A1 * 2/2011 Rocourt ..... A62B 35/0081 294/82.33
2011/0090079 A1 * 4/2011 Morino ..... A62B 35/0025 340/532
2011/0103558 A1 * 5/2011 Hooten ..... A62B 35/04 379/37

(Continued)

*Primary Examiner* — Katherine Mitchell
*Assistant Examiner* — Shiref Mekhaeil
(74) *Attorney, Agent, or Firm* — Armstrong Teasdale LLP

(57) ABSTRACT

A line connector for a personal fall protection system includes a carabiner having a loop portion that at least partially defines an opening. The opening is configured to receive a mating component of the personal fall protection system. The line connector also includes at least one sensor. Each at least one sensor includes a coil disposed around the loop portion of the carabiner. The line connector further includes a control unit coupled to the at least one sensor. The control unit is operable to send an excitation signal to the at least one sensor and determine whether the line connector is coupled to the mating component based on a response signal received from the at least one sensor.

21 Claims, 6 Drawing Sheets

(56) References Cited

U.S. PATENT DOCUMENTS

2012/0217091 A1* 8/2012 Baillargeon ..... G08B 21/02 182/18
2012/0302406 A1* 11/2012 Hinds ..... A63B 21/0055 482/8
2013/0118839 A1* 5/2013 Penn ..... B66B 11/06 187/262
2014/0041569 A1* 2/2014 Couch, III ..... B63B 1/121 114/259
2014/0323271 A1* 10/2014 Hinds ..... A63B 21/0442 482/8
2015/0180986 A1* 6/2015 Bisdikian ..... H04W 4/02 709/204
2015/0265860 A1* 9/2015 Kennedy ..... F16B 45/02 182/3
2015/0269875 A1* 9/2015 Corcoran ..... G09F 13/00 40/553
2015/0276521 A1* 10/2015 Moore, Jr. ..... A62B 35/0075 702/41

* cited by examiner

LINE CONNECTOR HAVING A LINK DETECTION SYSTEM AND METHOD OF MAKING SAME

BACKGROUND

The field of the disclosure relates generally to personal fall protection systems, and, more particularly, to systems for verifying the integrity of personal fall protection systems.

Many tasks require personnel to work at an elevation above ground level, such as upon ladders, scaffolding, paint-stacker lift platforms, and the like. At least some known regulations, industry standards, and/or company policies, such as ANSI/ASSE standard Z359, require a use of personal fall protection equipment for personnel exposed to fall hazards. For example, at least some such standards require each individual to wear a full-body harness. The harness is connected via a lanyard to an anchored, self-retracting lifeline. The lifeline is configured to limit a distance to which the individual wearing the harness can fall. However, such a system is not effective unless each line connector, such as D-rings, O-rings, and/or carabiners, of the harness, lanyard, and lifeline is securely coupled.

BRIEF DESCRIPTION

In one aspect, a line connector for a personal fall protection system is provided. The line connector includes a carabiner having a loop portion that at least partially defines an opening. The opening is configured to receive a mating component of the personal fall protection system. The line connector also includes at least one sensor. Each at least one sensor includes a coil disposed around the loop portion of the carabiner. The line connector further includes a control unit coupled to the at least one sensor. The control unit is operable to send an excitation signal to the at least one sensor and determine whether the line connector is coupled to the mating component based on a response signal received from the at least one sensor.

In another aspect, a personal fall protection system is provided. The personal fall protection system includes a harness, at least one line element, and a plurality of line connectors configured to couple to mating components for connecting the harness, the at least one line element, and an anchor. At least one of the plurality of line connectors includes a carabiner having a loop portion that at least partially defines an opening. The opening is configured to receive a mating component. The personal fall protection system also includes at least one sensor. Each at least one sensor includes a coil disposed around the loop portion. The personal fall protection system further includes a control unit coupled to the at least one sensor. The control unit is operable to send an excitation signal to the at least one sensor and determine whether the line connector is coupled to the mating component based on a response signal received from the at least one sensor.

In another aspect, a method of making a line connector for a personal fall protection system is provided. The method includes disposing a coil of at least one sensor around a loop portion of a carabiner to form the line connector. The loop portion of the carabiner at least partially defines an opening configured to receive a mating component of the personal fall protection system. The method also includes coupling a control unit to the at least one sensor. The control unit is operable to send an excitation signal to the at least one sensor, and determine whether the line connector is coupled to the mating component based on a response signal received from the at least one sensor.

The features, functions, and advantages that have been discussed can be achieved independently in various embodiments or may be combined in yet other embodiments further details of which can be seen with reference to the following description and drawings.

DETAILED DESCRIPTION

Embodiments of the line connector having a link detection system and method described herein provide for verification of the integrity of a personal fall protection system. The embodiments provide a line connector that includes a sensor and a control unit configured to detect whether the line connector is coupled to another line connector of the personal fall protection system. The embodiments further provide that at least one of the control unit, a personal monitor, and a workspace monitor alerts a user and/or a remote unit if a line connector is not coupled.

In one embodiment, technical effects of the methods, systems, and computer-readable media described herein include at least one of: (a) sending an excitation signal to at least one sensor, and (b) determining whether a line connector is coupled to a mating line connector based on a response signal received from the at least one sensor.

Figure 1:
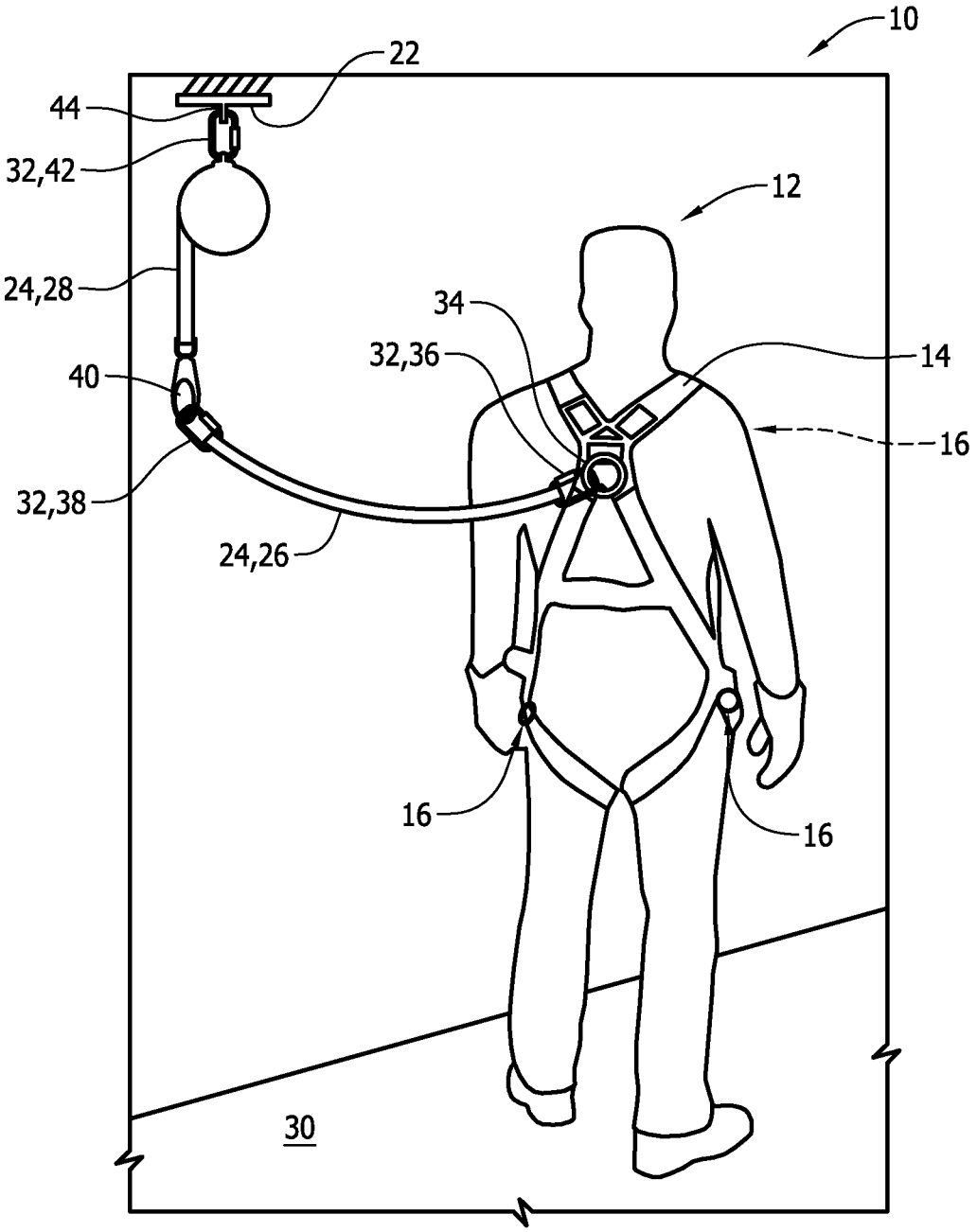
FIG. 1 is a schematic perspective view of an exemplary personal fall protection system.

Referring more particularly to the drawings, implementations of the disclosure may be described in the context of a personal fall protection system 10 shown schematically in FIG. 1. Personal fall protection system 10 includes a harness 14 configured to be worn by a user 12. Harness 14 includes a plurality of harness connectors 16 that are configured to facilitate donning and removal of harness 14 by user 12. In the illustrated embodiment, harness 14 is a three-clip harness that includes harness connectors 16 proximate each of a first hip of user 12, a second hip of user 12, and a chest area (not visible) of user 12. In other embodiments, harness 14 is any suitable harness that enables personal fall protection system 10 to function as described herein.

Harness 14 is configured to couple to an anchor 22 using at least one line element 24. When harness 14, the at least one line element 24, and anchor 22 are properly coupled together, user 12 has freedom of movement within a radius around anchor 22, and personal protection system 10 inhibits or precludes movement of user 12 beyond that radius. Harness 14, anchor 22, and the at least one line element 24 each are configured to support a weight of user 12 and any equipment carried by user 12, plus a dynamic acceleration force caused by a potential fall or other movement of user 12, multiplied by a safety factor. For example, in certain embodiments, personal protection system 10 limits a distance that user 12 can fall from an elevated area 30. In other embodiments, personal protection system 10 prevents user 12 from reaching an edge of elevated area 30.

In the illustrated embodiment, the at least one line element 24 includes a lanyard 26 and a self-retracting lifeline 28. Self-retracting lifeline 28 is configured to extend in response to a pulling force until a maximum length is reached. After self-retracting lifeline 28 reaches the maximum length, self-retracting lifeline 28 is not extendable. If the user moves toward anchor 22, self-retracting lifeline 28 is configured to retract. Thus, self-retracting lifeline 28 reduces slack in the at least one line element 24 and facilitates reducing an interference with activities performed by user 12. While the at least one line element 24 will be described partially in terms of lanyard 26 and self-retracting lifeline 28, it should be understood that in alternative embodiments, the at least one line element 24 includes any suitable number and type of elements that enable personal fall protection system 10 to function as described herein.

Personal fall protection system 10 also includes a plurality of line connectors 32 configured to couple to mating components of the harness 14, the at least one line element 24, and anchor 22. At least one of the plurality of line connectors 32 is configured to be received within, and securely coupled to, one of the plurality of mating components for the harness 14, the at least one line element 24, and anchor 22. In some embodiments, the mating components may comprise at least one of a D-ring, an O-ring, and a snap hook, but the mating component may alternatively comprise a carabiner. Each line connector 32 is of any suitable type that enables personal fall protection system 10 to function and to connect to a mating component as described herein, which mating components may include but are not limited to one of a D-ring, an O-ring, a snap hook, and a carabiner.

For example, but not by way of limitation, in the illustrated embodiment, harness 14 includes a dorsally located harness O-ring connector 34. Lanyard 26 includes a first lanyard carabiner 36 at a first end and a second lanyard carabiner 38 at an opposite second end. Self-retracting lifeline 28 includes a lifeline snap hook 40 at a strap end and a lifeline housing carabiner 42. Anchor 22 includes an anchor ring 44. First lanyard carabiner 36 is configured to be received within, and securely coupled to, harness O-ring connector 34 (and vice versa), second lanyard carabiner 38 is configured to be received within, and securely coupled to, lifeline snap hook 40 (and vice versa), and lifeline housing carabiner 42 is configured to be received within, and securely coupled to, anchor ring 44 (and vice versa).

Figure 2:
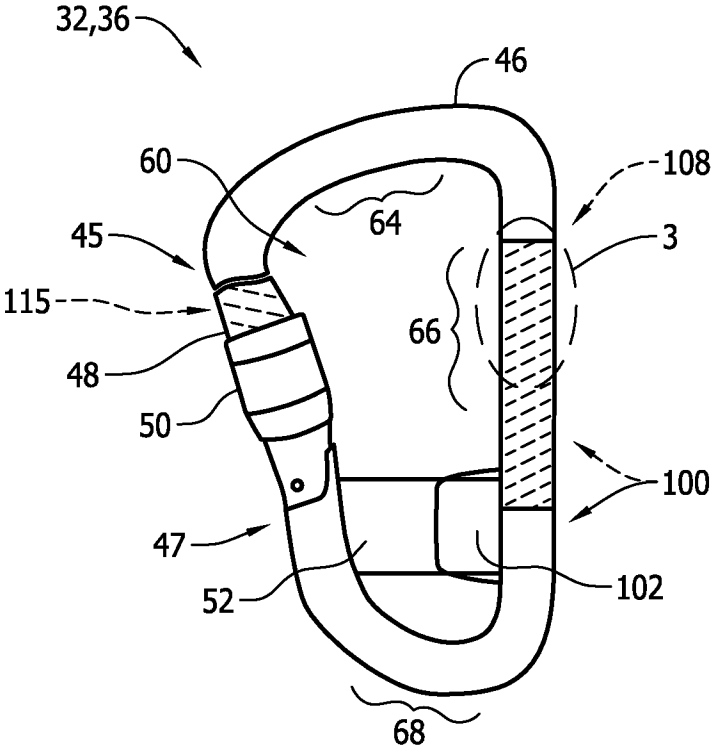
FIG. 2 is a schematic view of an exemplary line connector that may be used with the personal fall protection system shown in FIG. 1.

FIG. 2 is a schematic view of an exemplary line connector 32 that may be used with personal fall protection system 10. Line connector 32 may be a carabiner 36, for example, which includes a spine defining a loop portion 46 that extends from a first end 45 to a second end 47. Loop portion 46 at least partially defines an opening 60 that extends through line connector 32. Opening 60 is configured to receive, and securely couple to, a mating line connector 32. In the illustrated embodiment, line connector 32 is a carabiner that also includes a latch gate portion 48 pivotally connected between the first end 45 and the second end 47, and a screw-lock 50 that is rotatable to releasably engage and secure the gate or latch portion in a locked condition to prevent the gate from opening. In alternative embodiments, line connector 32 is another type of connector that includes loop portion 46, such as but not limited to a snap hook.

Line connector 32 also includes a link detection system 100. Link detection system 100 is configured to detect whether line connector 32 is coupled to a mating line connector 32 of personal fall protection system 10. With reference also to FIG. 1, in one example, line connector 32 is first lanyard carabiner 36, and link detection system 100 detects whether harness first lanyard carabiner 36 is connected to harness O-ring connector 34. For another example, line connector 32 is second lanyard carabiner 38, and link detection system 100 detects whether second lanyard carabiner 38 is connected to lifeline snap hook 40. For another example, line connector 32 is lifeline housing carabiner 42, and link detection system 100 detects whether lifeline housing carabiner 42 is connected to anchor ring 44. Each of a plurality of link detection systems 100 is coupled to a corresponding one of line connectors 32 to facilitate detection of whether user 12 is securely coupled to anchor 22 via harness 14 and the at least one line element 24.

Figure 3:
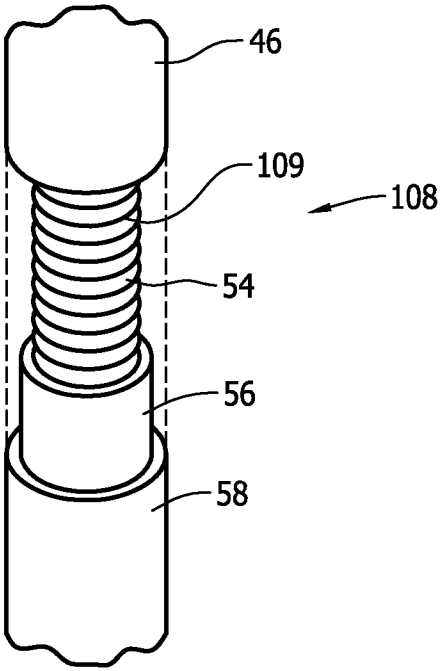
FIG. 3 is a schematic cutaway view of the line connector shown in FIG. 2.

FIG. 3 is a schematic cutaway view of a portion of line connector 32 designated as portion 3 in FIG. 2. With reference to FIGS. 2 and 3, link detection system 100 includes a control unit 102 and at least one sensor 108. In the illustrated embodiment, the at least one sensor 108 is coupled to the spine or loop portion 46 of a carabiner that may form line connector 32. More specifically, each sensor 108 includes an inductive coil 109 disposed around at least a portion of loop portion 46. For example, coil 109 of each sensor 108 extends along a length of loop portion 46 that is about 0.5 inches. For another example, coil 109 of each sensor 108 extends along at least a portion of a length of loop portion 46 of a carabiner that is between about 0.5 inches and about 1 inch. For another example, coil 109 of each sensor 108 extends along a length of loop portion 46 that is between about 1 inch and about 2 inches. For another example, the at least one sensor 108 is a single sensor 108, and coil 109 extends along a length of loop portion 46 that is less than or equal to approximately 90 percent of a length of loop portion 46. In alternative embodiments, each coil 109 extends along any suitable respective length of loop portion 46 of a carabiner that enables link detection system 100 to function as described herein.

In certain embodiments, coil 109 is disposed around a base 54 of the spine or loop portion 46 of a carabiner, and covered or coated to avoid potential damage to coil 109. For example, in the illustrated embodiment, sensor 108 is covered by a shell 56, such as but not limited to a hard epoxy coating. Shell 56 protects the at least one sensor 108 and facilitates maintaining a predetermined loop spacing of coil 109. Shell 56 is covered by an outer coating 58, such as but not limited to a rubberized epoxy coating. Outer coating 58 facilitates also protects sensor 108 and facilitates gripping and handling of line connector 32 by user 12. In alternative embodiments, sensor 108 is coupled to line connector 32 in any suitable fashion that enables link detection system 100 to function as described herein.

Control unit 102 is coupled to line connector 32. In the illustrated embodiment, control unit 102 is coupled to a cross-bar 52 that extends across opening 60. In an embodiment, cross-bar 52 is welded to base 54, and each of cross-bar 52 and control unit 102 is covered with an outer coating that is similar to outer coating 58. In alternative embodiments, control unit 102 is coupled to line connector 32 in any suitable fashion that enables link detection system 100 to function as described herein.

Figure 4:
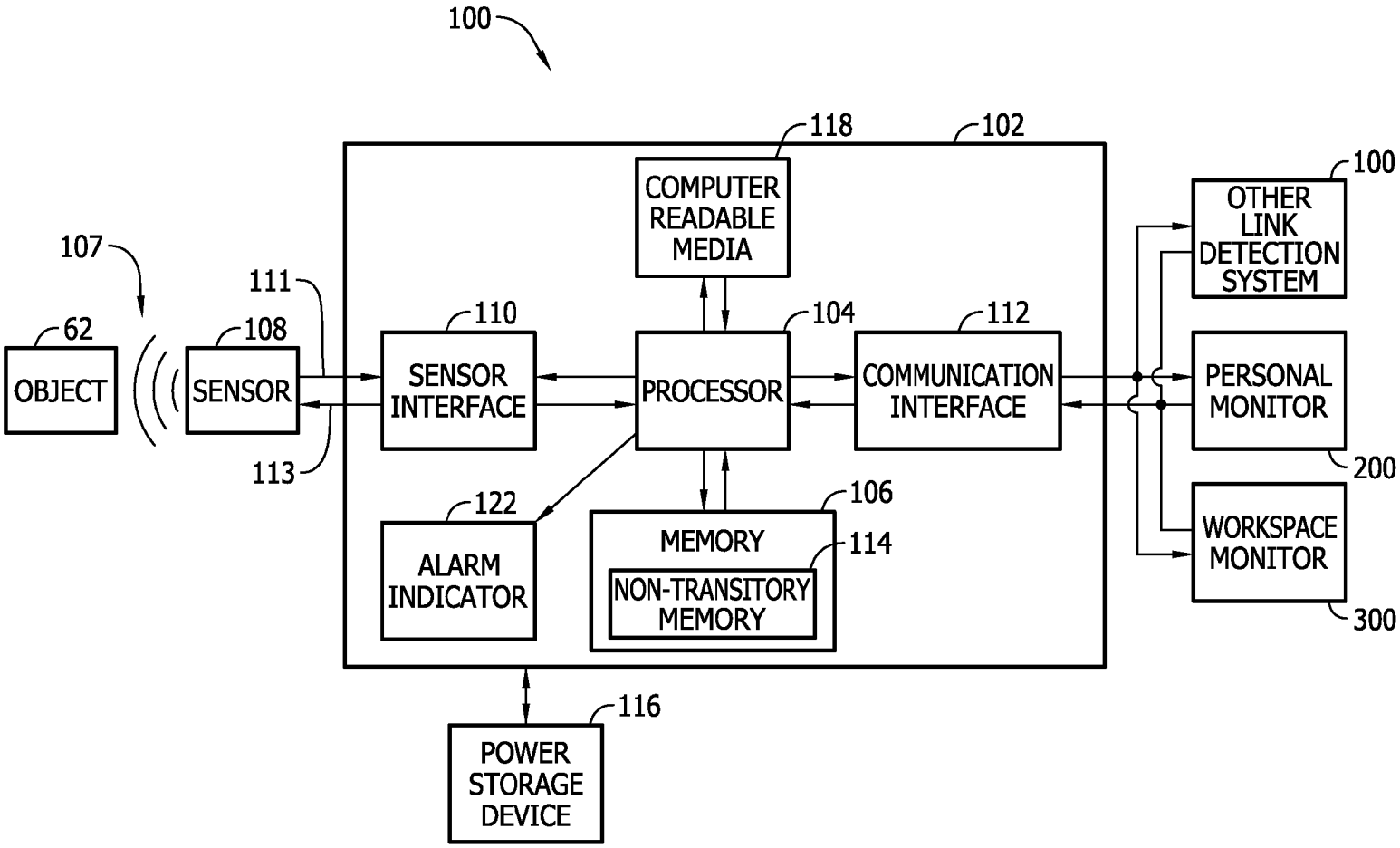
FIG. 4 is a schematic block diagram of an exemplary link detection system that may be used with the line connector shown in FIG. 2 and the personal fall protection system shown in FIG. 1.

FIG. 4 is a schematic block diagram of an embodiment of link detection system 100. In the illustrated embodiment, control unit 102 of link detection system 100 includes a memory 106 and a processor 104 that is coupled to memory 106 for executing programmed instructions. Processor 104 may include one or more processing units (e.g., in a multi-core configuration). Link detection system 100 is programmable to perform one or more operations described herein by programming memory 106 and/or processor 104. For example, processor 104 may be programmed by encoding an operation as one or more executable instructions and providing the executable instructions in memory device 106.

Processor 104 may include, but is not limited to, a general purpose central processing unit (CPU), a microcontroller, a reduced instruction set computer (RISC) processor, an application specific integrated circuit (ASIC), a programmable logic circuit (PLC), and/or any other circuit or processor capable of executing the functions described herein. The methods described herein may be encoded as executable instructions embodied in a computer-readable medium including, without limitation, a storage device and/or a memory device. The computer-readable medium may be non-transitory. Such instructions, when executed by processor 104, cause link detection system 100 to perform at least a portion of the methods described herein. The above examples are exemplary only, and thus are not intended to limit in any way the definition and/or meaning of the term processor.

Memory device 106, as described herein, is one or more devices that enable information such as executable instructions and/or other data to be stored and retrieved. Memory device 106 may include one or more computer-readable media, such as, without limitation, dynamic random access memory (DRAM), static random access memory (SRAM), a solid state disk, and/or a hard disk. Memory device 106 may be configured to store, without limitation, event logs, diagnostic entries, fault messages, and/or any other type of data suitable for use with the methods and systems described herein.

In the illustrated embodiment, control unit 102 includes an sensor interface 110 that is operable to send an excitation signal 113 to, and receive a response signal 111 from, the at least one sensor 108. Each at least one sensor 108 is operable to generate a response signal 111 that is representative of a presence of an object 62 proximate sensor 108. More specifically, the at least one sensor 108 is an inductive sensor, and sensor interface 110 is operable to cause each sensor 108 to generate a suitable electromagnetic field 107, and to detect modifications of electromagnetic field 107 induced by the presence of object 62 as response signal 111, using any suitable combination of electronic hardware, firmware, and software.

Processor 104 is programmed to perform certain operations using sensor data obtained from response signal 111 received through sensor interface 110, in accordance with the methods described herein. Sensor interface 110 is further operable to transform response signal 111 into a form that is usable by processor 104.

In the illustrated embodiment, control unit 102 includes a communication interface 112 coupled to at least one of memory device 106 and processor 104. Communication interface 112 is operable to communicate with at least one remote device, such as another link detection system 100, a personal monitor 200, a workspace monitor 300, or any other suitable system that enables link detection system 100 to function as described herein. In certain embodiments, communication interface 112 is a wireless communication interface. For example, communication interface 112 is at least one of a wireless network adapter and a mobile telecommunications adapter. In an embodiment, communication interface 112 is a radio frequency ("RF") transmitter/receiver that uses a standard transmission protocol such as BLUETOOTH®, ZIGBEE®, or active radio frequency identification ("RFID"). In another embodiment, communication interface 112 includes a non-RF wireless transmitter/receiver, such as without limitation an optical transmitter/receiver that utilizes infrared and/or visible wavelengths. It should be understood that the particular system used for wireless communication is not intended to limit the disclosure. In alternative embodiments, communication interface 112 includes a wired communication interface, such as a wired network adapter, and link detection system 100 is connected to remote devices using wires extending through the at least one line element 24 (shown in FIG. 1).

Processor 104 is programmed to selectively activate communication interface 112 to transmit signals to, and receive signals from, at least one of the other link detection system 100, personal monitor 200, workspace monitor 300, and another suitable system, and to convert such signals to and from a form that is usable by processor 104. For example, processor 104 is programmed to perform certain operations based on signals received through communication interface 112 and to cause certain signals to be transmitted through communication interface 112, in accordance with the methods described herein.

In the illustrated embodiment, instructions for operating systems and applications are located in a functional form on a non-transitory portion 114 of memory device 106 for execution by processor 104 to perform one or more of the processes described herein. Additionally or alternatively, these instructions may be embodied on different physical or tangible computer-readable media, such as at least one of another memory device (not shown) and a computer-readable media 118, which may include, without limitation, a flash drive, CD-ROM, thumb drive, floppy disk, etc. Computer-readable media 118 is selectively coupleable to control unit 102 to permit access and/or execution by processor 104. In one example, computer-readable media 118 includes an optical or magnetic disc that is inserted or placed into a CD/DVD drive or other device coupleable to memory device 106 and/or processor 104. In some embodiments, computer-readable media 118 is not removable.

In the illustrated embodiment, link detection system 100 also includes at least one power storage device 116. Power storage device 116 provides power for operation of link detection system 100. In a particular embodiment, power storage device 116 includes a battery. Additionally or alternatively, power storage device 116 includes an ultra-capacitor. Additionally or alternatively, power storage device 116 includes a fuel cell. Additionally or alternatively, power storage device 116 includes any suitable power storage system that enables link detection system 100 to function as described herein.

In certain embodiments, link detection system 100 also includes an alarm indicator 122. Processor 104 is configured to activate alarm indicator 122 when processor 104 determines that line connector 32 is not coupled to a mating line connector 32 of personal fall protection system 10. Alarm indicator 122 includes at least one of a visual display, an audio alarm, an audio computer-voice generated message, and another suitable alarm notification output. In alternative embodiments, link detection system 100 does not include alarm indicator 122, and user 12 relies on at least one of personal monitor 200 and workspace monitor 300 to provide alarm notifications.

With reference to FIGS. 1-4, in certain embodiments, sensor interface 110 and/or processor 104 are configured to determine whether line connector 32 is securely coupled to a mating component, such as harness O-ring connector 34, lifeline snap hook 40 or anchor ring 44, based on response signal 111. For example, sensor interface 110 and/or processor 104 are configured to determine whether object 62 is a mating component (34, 40, 44) extending through opening 60. In an embodiment, memory 106 stores a table of expected mating line connector response signals each associated with a presence of one of a plurality of types of a mating component extending through opening 60. Processor 104 compares response signal 111 to the table to determine if response signal 111 matches an expected mating component response. The expected mating component response of each of the plurality types of line connector 32 may be based, for example but not by way of limitation, on at least one of a material from which each type is formed and a shape of each type. Additionally or alternatively, memory 106 stores a table of expected environmental noise response signals each associated with a presence of one of a plurality of sources of environmental noise, such as a metal post or guard rail, proximate opening 60. Processor 104 compares response signal 111 to the table to determine if response signal 111 matches an expected environmental noise response. In alternative embodiments, control unit 102 uses any suitable combination of electronic hardware, firmware, and software to analyze response signal 111 to determine whether object 62 is a mating line connector 32 extending through opening 60.

In some embodiments, the at least one sensor 108 comprises a plurality of sensors 108. Each of the plurality of sensors 108 includes a respective coil 109 located at a different position along a spine or loop portion 46 of a carabiner, and each coil 109 generates a separate electromagnetic field 107 and response signal 111. Processor 104 and/or sensor interface 110 is further configured to determine whether line connector 32 is securely coupled to a mating component (34, 40, 44) based on each response signal 111 from each respective sensor 108. For example, processor 104 and/or sensor interface 110 is configured to analyze each response signal 111 based on a known position of the respective coil 109 along loop portion 46 to determine whether object 62 is a mating component extending through opening 60.

In a particular embodiment, plurality of sensors 108 includes a first sensor 108 positioned along a first portion 64 of loop portion 46 of a carabiner, and a second sensor 108 positioned along a second portion 66 of loop portion 46 of the carabiner that is substantially non-parallel to first portion 64. In another particular embodiment, plurality of sensors 108 includes first sensor 108 positioned along first portion 64 of loop portion 46 of a carabiner, and a third sensor 108 positioned along a third portion 68 of loop portion 46 of the carabiner that is substantially opposite to first portion 64 across opening 60. In another particular embodiment, plurality of sensors 108 includes each of first sensor 108, second sensor 108, and third sensor 108 positioned respectively along first portion 64, second portion 66, and third portion 68 of loop portion 46 of the carabiner. Although first portion 64, second portion 66, and third portion 68 are illustrated on line connector 32 as a carabiner, it should be understood that such arrangements of plurality of sensors 108 are applicable to embodiments in which line connector 32 is a snap hook or other suitable connector with a pivoting gate/latch portion or opening link that enables link detection system 100 to function as described herein. In alternative embodiments, plurality of sensors 108 includes any suitable number of sensors 108 positioned at any suitable locations along loop portion 46 that enable link detection system 100 to function as described herein.

In certain embodiments, the at least one sensor 108 includes a sensor 115 positioned on or adjacent to the gate or latch portion 48 of a carabiner that forms line connector 32. Processor 104 and/or sensor interface 110 is further configured to determine whether line connector 32 is securely coupled to a mating component based on response signal 111 from sensor 115. For example, processor 104 and/or sensor interface 110 are configured to determine whether line connector 32 is in a latched or locked configuration based on response signal 111 from sensor 115. For example, sensor 115 includes a coil similar to coil 109, shown in FIG. 3, that is positioned or disposed adjacent to gate or latch portion 48 of the carabiner, and response signal 111 indicates whether screw-lock 50 has been rotated to engage and secure gate or latch portion 48 in a locked condition to prevent gate or latch portion 48 from opening. Accordingly, the sensor 115 enables determining when line connector 32 is securely coupled to a mating component, such as mating components 34, 40, 44 of personal fall protection system 10 (shown in FIG. 1).

It should be understood that a minimum number of link detection systems 100 needed to verify that user 12 is securely coupled to anchor 22 via personal fall protection system 10 corresponds to a number of line connectors 32 included in personal fall protection system 10. For example, in the embodiment illustrated in FIG. 1, personal fall protection system 10 includes three line connectors 32, specifically first lanyard carabiner 36 coupled to harness O-ring connector 34, second lanyard carabiner 38 coupled to lifeline snap hook 40, and lifeline housing carabiner 42 coupled to anchor ring 44. Three link detection systems 100 (not shown in FIG. 1) are sufficient to verify an integrity of personal fall protection system 10, specifically a first link detection system 100 coupled to one of first lanyard carabiner 36 and harness O-ring connector 34, a second link detection system 100 coupled to one of second lanyard carabiner 38 and lifeline snap hook 40, and a third link detection system 100 coupled to one of lifeline housing carabiner 42 and anchor ring 44. However, it should be understood that link detection systems 100 can also be employed with typical standard lanyards. For example, link detection systems 100 can be installed as standard equipment on harness O-ring connector 34, lifeline snap hook 40, and lifeline housing carabiner 42 to enable complete verification of the integrity of personal fall protection system 10 with any typical standard lanyard 26. Alternatively, in addition to link detection systems 100 included with the first, second and third lanyard carabiners that form the line connectors 32, an additional link detection system 100 may be coupled to any of harness O-ring connector 34, lifeline snap hook 40, and anchor ring 44 to add redundancy to the verification of the integrity of personal fall protection system 10.

Although link detection system 100 is shown coupled to line connector 32 in the illustrated embodiment, it should be understood that link detection system 100 also may be coupled to at least one harness connector 16. In such embodiments, link detection system 100 enables verification that harness connectors 16 are securely coupled in substantially the same fashion as described herein for line connectors 32.

In alternative embodiments, one of another link detection system 100, personal monitor 200, and workspace monitor 300 is configured to determine, using information from the at least one sensor 108 as transmitted by control unit 102, whether line connector 32 is securely coupled to a mating component (e.g. 34, 40, 44). For example, one of another link detection system 100, personal monitor 200, and workspace monitor 300 is configured to determine, in a similar fashion as described above and using information from the at least one sensor 108 as transmitted by control unit 102, whether object 62 is a mating component extending through opening 60. For another example, one of another link detection system 100, personal monitor 200, and workspace monitor 300 is configured to determine, in a similar fashion as described above and using information from sensor 115 positioned on latch portion 48 as transmitted by control unit 102, whether line connector 32 is in the latched configuration and whether screw-lock 50 is rotated to engage and secure the latch portion 48 in a locked position to prevent the gate or latch portion 48 from opening.

In certain embodiments, non-transitory portion 114 of memory device 106 is configured to store a connector ID tag for line connector 32. Processor 104 is configured to include the connector ID tag in transmissions of data from the at least one sensor 108 via communication interface 112 to enable at least one of another link detection system 100, personal monitor 200, and workspace monitor 300 to associate data from the at least one sensor 108 with the respective line connector 32. Moreover, the connector ID tag may be persistently associated with the one of harness 14, line element 24, and anchor 22 of which line connector 32 is a component, to enable tracking of historical data for the one of harness 14, line element 24, and anchor 22.

Figure 5:
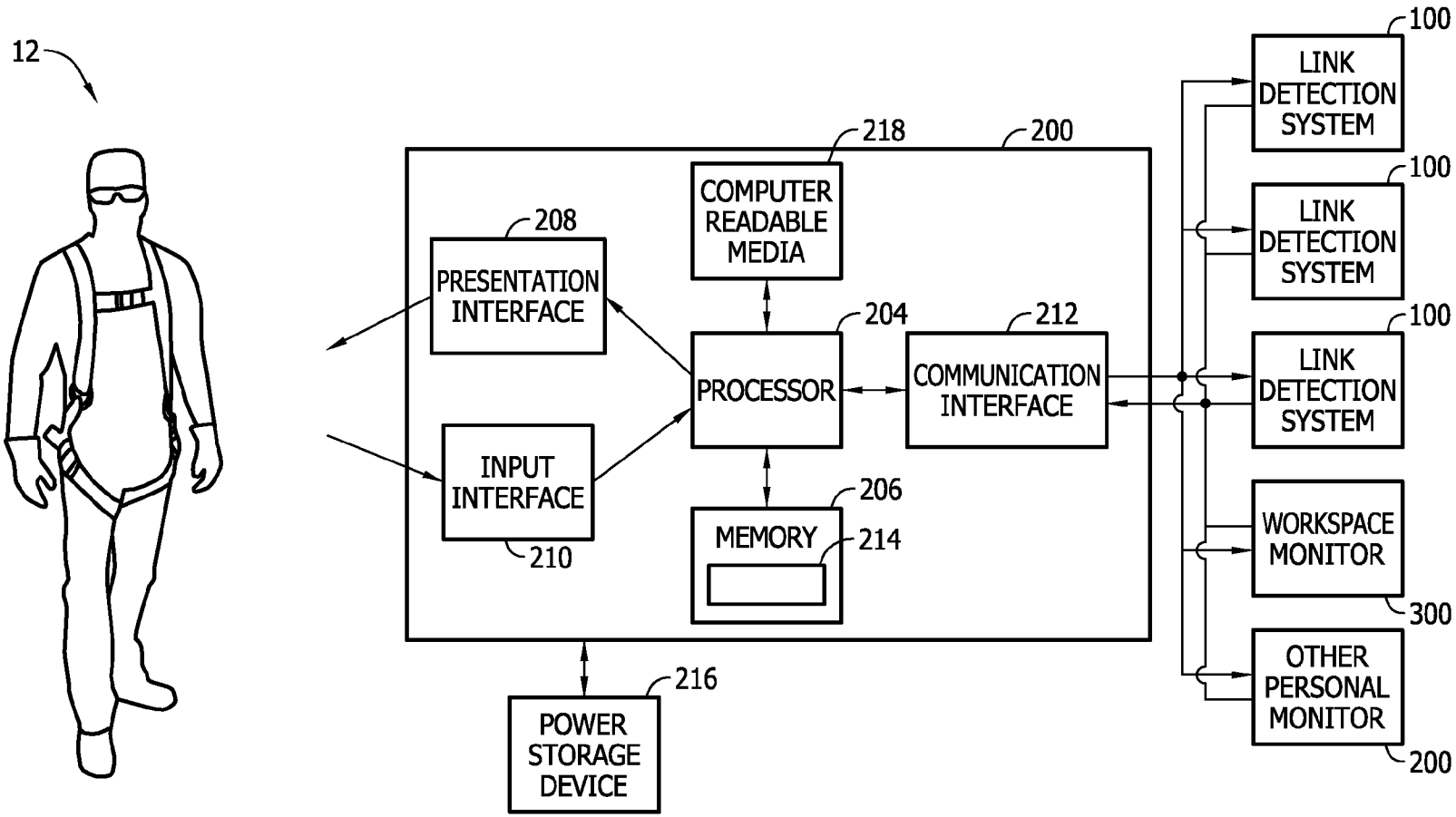
FIG. 5 is a schematic block diagram of an exemplary personal monitor that may be used with the link detection system shown in FIG. 4.

FIG. 5 is a schematic block diagram of an embodiment of personal monitor 200. Personal monitor 200 is configured to monitor data transmitted from each link detection system 100 associated with user 12, and to alert user 12 when any line connector 32 associated with user 12 is not securely coupled to a mating component. In certain embodiments, personal monitor 200 is sized to be worn by user 12. For example, but not by way of limitation, personal monitor 200 is configured to couple to harness 14 as worn by user 12. In alternative embodiments, personal monitor 200 is configured to be suitably positioned proximate elevated area 30 (shown in FIG. 1), such that communication between personal monitor 200 and each link detection system 100 associated with user 12 is enabled.

In the illustrated embodiment, personal monitor 200 includes a memory 206 and a processor 204 that is coupled to memory 206 for executing programmed instructions. Processor 204 and memory 206 are similar to processor 104 and memory 106, as described herein. Personal monitor 200 is programmable to perform one or more operations described herein by programming memory 206 and/or processor 204. For example, processor 204 may be programmed by encoding an operation as one or more executable instructions and providing the executable instructions in memory device 206.

In the illustrated embodiment, personal monitor 200 includes a presentation interface 208 configured to present output to user 12. Presentation interface 208 is coupled to processor 204. Presentation interface 208 outputs (e.g., visual display, audio alarm, audio computer-voice generation, and/or otherwise output) information such as, but not limited to, whether each line connector 32 associated with user 12 is securely coupled to a mating component, as well as installation data, configuration data, test data, error messages, and/or any other type of data to user 12. For example, but not by way of limitation, presentation interface 208 may include at least one of a touch screen display, LED indicator lights, and a speaker. Additionally or alternatively, presentation interface 208 includes a display adapter (not shown in FIG. 5) that is coupleable to an external display device, such as a cathode ray tube (CRT), a liquid crystal display (LCD), a light-emitting diode (LED) display, an organic LED (OLED) display, and/or an "electronic ink" display. In some implementations, presentation interface 208 includes more than one display device. Additionally or alternatively, presentation interface 208 is coupleable to a printer.

In the illustrated embodiment, personal monitor 200 includes an input interface 210 configured to receive input from user 12. For example, but not by way of limitation, input interface 210 may be configured to receive configuration data from user 12 for each link detection system 100 associated with user 12, as well as selections, requests, credentials, and/or any other type of inputs from user 12 suitable for use with the methods and systems described herein. In the exemplary implementation, input interface 210 may include, for example, a touch sensitive panel (e.g., a touch pad or a touch screen), a keypad, a card reader (e.g., a smartcard reader), a pointing device, a mouse, a stylus, a gyroscope, an accelerometer, a position detector, and/or an audio input interface. It should be understood that a single component, such as a touch screen, may function as both a display device of presentation interface 208 and as input interface 210.

In the illustrated embodiment, personal monitor 200 includes a communication interface 212 coupled to at least one of memory device 206 and processor 204. Communication interface 212 is similar to communication interface 112, as described above. Communication interface 212 is operable to communicate with at least one of any suitable number of link detection systems 100 associated with user 12, another personal monitor 200, workspace monitor 300, and any other suitable system that enables personal monitor 200 to function as described herein.

Processor 204 is programmed to selectively activate and deactivate communication interface 212. When activated, communication interface 212 is operable to transmit signals to, and receive signals from, at least one of any suitable number of link detection systems 100 associated with user 12, another personal monitor 200, workspace monitor 300, and any other suitable system that enables personal monitor 200 to function as described herein, and to convert such signals to and from a form that is usable by processor 204. Processor 204 is programmed to perform certain operations based on signals received through communication interface 212 and to cause certain signals to be transmitted through communication interface 212, in accordance with the methods described herein. For example, communication interface 212 enables processor 204 to monitor data transmitted from each link detection system 100 associated with user 12. For another example, communication interface 212 enables processor 204 to send data and instructions to each link detection system 100 associated with user 12.

In certain embodiments, non-transitory portion 214 of memory device 206 is configured to store a monitor ID tag for personal monitor 200. Alternatively, the monitor ID tag is entered into memory device 206 by user 12 via input interface 210. Processor 204 is configured to include the monitor ID tag in transmissions of data via communication interface 212 to enable at least one of another personal monitor 200, one of a plurality of link detection systems 100, and workspace monitor 300 to associate the transmitted data with personal monitor 200. Moreover, the monitor ID tag may be persistently associated with user 12 to enable tracking of historical data for each user 12.

Additionally or alternatively, personal monitor 200 is configured to track historical data for user 12 as obtained from each link detection system 100 associated with user 12, such as but not limited to the identification tag for each line connector 32 and historical data from each corresponding at least one sensor 108, and to report the historical data to presentation interface 208. Additionally or alternatively, personal monitor 200 is configured to send an electronic notification message, for example to safety personnel, when it receives data indicating that a link detection system 100 associated with user 12 has detected that a line connector 32 is not securely coupled while the user 12 is on elevated area 30.

In the illustrated embodiment, instructions for operating systems and applications are located in a functional form on a non-transitory portion 214 of memory device 206 for execution by processor 204 to perform one or more of the processes described herein. Additionally or alternatively, these instructions may be embodied on different physical or tangible computer-readable media, such as at least one of another memory device (not shown) and a computer-readable media 218. Computer-readable media 218 is similar to computer-readable media 118, as described above, and likewise may be removable. In the illustrated embodiment, personal monitor 200 also includes at least one power storage device 216 that is similar to power storage device 116, as described above.

Figure 6:
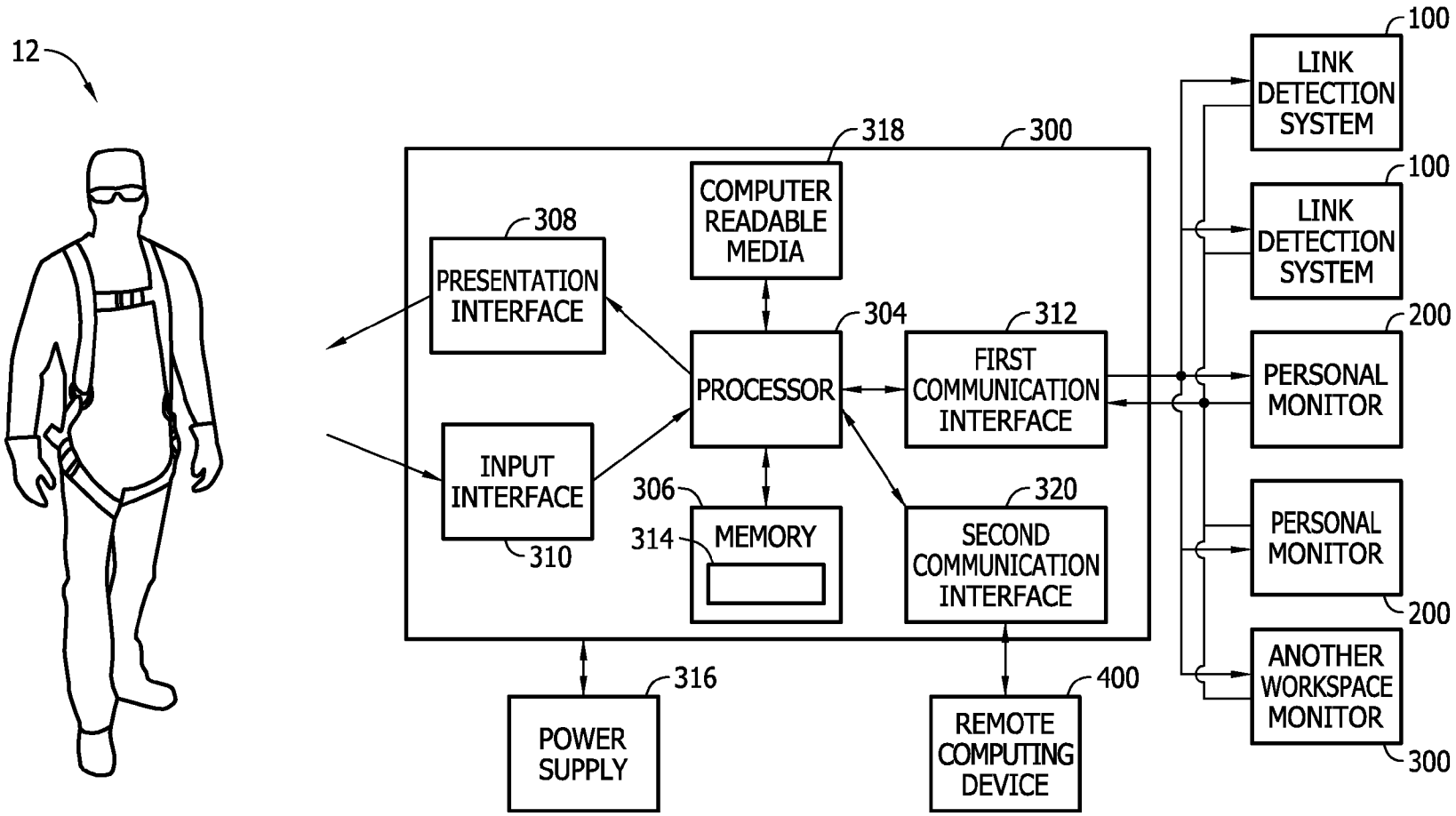
FIG. 6 is a schematic block diagram of an exemplary workspace monitor that may be used with the link detection system shown in FIG. 4 and the personal monitor shown in FIG. 5.

FIG. 6 is a schematic block diagram of an embodiment of workspace monitor 300. Workspace monitor 300 is configured to monitor data transmitted from a plurality of personal monitors 200 each associated with a respective user 12 and, alternatively or additionally, from a plurality of link detection systems 100 associated with at least one user 12. In certain embodiments, workspace monitor 300 is configured to be removably installed at a fixed location on elevated area 30.

In the illustrated embodiment, workspace monitor 300 includes a memory 306 coupled to a processor 304, similar to memory 206 and processor 204 described above, a presentation interface 308 and an input interface 310, similar to presentation interface 208 and input interface 210 described above, a memory 306, a non-transitory memory 314, and a computer readable media 318 similar to memory 206, non-transitory memory 214, and computer readable media 218 described above, and a first communication interface 312 similar to communication interface 212 described above. First communication interface 312 is operable to communicate with at least one of any suitable number of link detection systems 100 associated with at least one user 12, any suitable number of personal monitors 200 each associated with a respective user 12, another workspace monitor 300, and any other suitable system that enables workspace monitor 300 to function as described herein.

Workspace monitor 300 is coupled to a power supply 316. In certain embodiments, power supply 316 is similar to power storage device 216. Additionally or alternatively, power supply 316 is a suitable facility electrical line.

In certain embodiments, workspace monitor 300 includes a second communication interface 320. Second communication interface 320 is operable to communicate with at least one remote computing device 400. In certain embodiments, second communication interface 320 is a wireless communication interface. For example, second communication interface 320 is at least one of a wireless network adapter and a mobile telecommunications adapter. In an embodiment, second communication interface 320 is a radio frequency ("RF") transmitter/receiver that uses a standard transmission protocol such as BLUETOOTH®, ZIGBEE®, or active radio frequency identification ("RFID"). In another embodiment, second communication interface 320 includes a non-RF wireless transmitter/receiver, such as without limitation an optical transmitter/receiver that utilizes infrared and/or visible wavelengths. It should be understood that the particular system used for wireless communication is not intended to limit the disclosure. In alternative embodiments, second communication interface 320 includes a wired communication interface, such as a wired network adapter, and link detection system 100 is connected to remote devices using wires extending through the at least one line element 24 (shown in FIG. 1). In alternative embodiments, second communication interface 320 is not present, and first communication interface 312 is further operable to communicate with the at least one remote computing device 400.

In certain embodiments, workspace monitor 300 is configured to selectively transmit a beacon signal via first communication interface 312. At least one of link detection system 100 and personal monitor 200 is configured to detect the beacon signal to determine that user 12 is on elevated area 30. The one of link detection system 100 and personal monitor 200 is further configured such that, if it is detected that a line connector 32 associated with user 12 is not securely coupled to a mating component (e.g., 34, 40, 44), the one of link detection system 100 and personal monitor 200 triggers an alarm condition only if the beacon signal also has been detected.

In some embodiments, workspace monitor 300 is configured to perform any or all of the functions as described above for personal monitor 200. Additionally or alternatively, workspace monitor 300 is configured to track historical data for a plurality of users 12 as obtained from each personal monitor 200, such as but not limited to the monitor ID tag, the connector ID tag for each line connector 32, and historical data from each corresponding at least one sensor 108, and to report the historical data to at least one of presentation interface 308 and the at least one remote computing device 400. Additionally or alternatively, workspace monitor 300 is configured to track historical data for a plurality of users 12 as obtained from each link detection system 100 associated with each respective user 12, and to report the historical data to at least one of presentation interface 308 and the at least one remote computing device 400.

Figure 7:
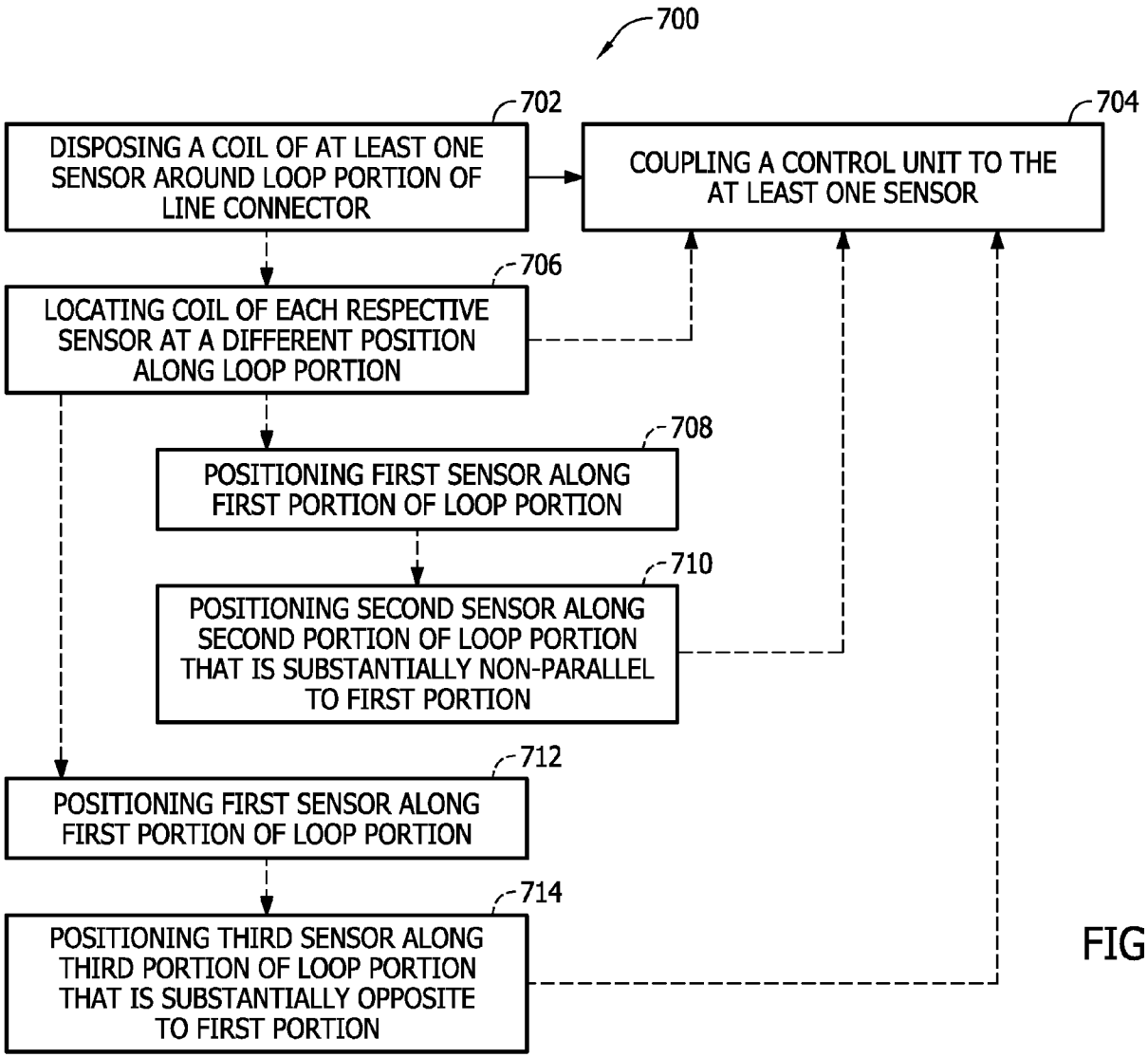
FIG. 7 is a flow diagram of an exemplary method of making a line connector, such as the line connector shown in FIG. 2, for a personal fall protection system, such as the personal fall protection system shown in FIG. 1.

FIG. 7 is a flow diagram of a method 700 of making a line connector, such as line connector 32, for a personal fall protection system, such as personal fall protection system 10. With reference to FIGS. 1-7, in the illustrated embodiment, method 700 includes disposing 702 or positioning a coil of at least one sensor, such as coil 109 of the at least one sensor 108, around a loop portion of the carabiner to form the line connector, such as loop portion 46. The loop portion at least partially defines an opening, such as opening 60, configured to receive a mating component, such as harness O-ring 34, lifeline snap hook 40, or anchor ring 44, or even another line connector 32, of the personal fall protection system. Method 700 also includes coupling 704 a control unit, such as control unit 102, to the at least one sensor. The control unit is operable to send an excitation signal, such as excitation signal 113, to the at least one sensor, and to determine whether the line connector is coupled to the mating line connector based on a response signal, such as response signal 111, received from the at least one sensor.

In certain embodiments, method 700 includes additional steps, shown in dashed lines in FIG. 7. For example, in certain embodiments, the at least one sensor includes a plurality of sensors, and disposing 702 the coil around the loop portion includes locating 706 the coil of each respective sensor at a different position along the loop portion. Moreover, in some embodiments, locating 706 the coil of each respective sensor at a different position includes positioning 708 a first sensor along a first portion of the loop portion, such as first portion 64, and positioning 710 a second sensor along a second portion of the loop portion, such as second portion 66, that is substantially non-parallel to the first portion. Additionally or alternatively, in some embodiments, locating 706 the coil of each respective sensor at a different position includes positioning 712 a first sensor along a first portion of the loop portion, such as first portion 64, and positioning 714 a third sensor along a third portion of the loop portion, such as third portion 68, that is substantially opposite to the first portion across the opening.

The embodiments described herein provide a line connector having a link detection system that detects whether the line connector is coupled to another line connector of the personal fall protection system. The embodiments provide that the user is alerted as to the uncoupled line connector by at least one of the link detection system, a personal monitor that can be worn by the user, and a workspace monitor located in the work area. The embodiments also provide that at least one of the personal monitor and workspace monitor tracks historical user and equipment data.

The embodiments described herein provide improvements over at least some known personal fall protection systems. As compared to at least some known personal fall protection systems, the embodiments described herein enable increased reliability in a verification of the integrity of the personal fall protection system, without requiring the user to take additional steps or to connect additional monitoring lines when donning the harness and connecting to the anchor. As compared to at least some known personal fall protection systems, the embodiments described herein provide a single link detection system that is universally operable with couplings among a wide range of types of line connectors, enabling a use of various configurations of line elements and anchors without a need to customize the link detection hardware for every changed configuration.

This written description uses examples to disclose various implementations, which include the best mode, to enable any person skilled in the art to practice those implementations, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A line connector for a personal fall protection system, said line connector comprising:

a carabiner having a loop portion that at least partially defines an opening, said opening configured to receive a mating component for a harness of the personal fall protection system, the mating component for the harness including at least one of a D-ring, an O-ring and a snap hook;

at least one sensor that comprises a coil disposed around said loop portion of said carabiner; and a control unit coupled to said at least one sensor, said control unit operable to:

send an excitation signal to said at least one sensor to cause said at least one sensor to generate an electromagnetic field in response to the excitation signal and to detect a modification of the electromagnetic field induced by the presence of an object as a response signal, wherein said control unit is configured to determine whether the presence of the object that induces the detected modification of the electromagnetic field is associated with the mating component extending through said opening, and to determine that said line connector is coupled to the mating component based on the detected modification of the electromagnetic field induced by the mating component and detected by said at least one sensor.

2. The line connector according to claim 1, wherein said control unit comprises a communication interface configured to communicate with one of a personal monitor and a workspace monitor.

3. The line connector according to claim 1, wherein said at least one sensor comprises a plurality of sensors, each said coil of said plurality of sensors located at a different position along said loop portion of said carabiner.

4. The line connector according to claim 3, wherein said plurality of sensors comprises a first sensor positioned along a first portion of said loop portion of said carabiner, and a second sensor positioned along a second portion of said loop portion of said carabiner that is substantially non-parallel to said first portion.

5. The line connector according to claim 3, wherein said plurality of sensors comprises a first sensor positioned along a first portion of said loop portion of said carabiner, and a third sensor positioned along a third portion of said loop portion of said carabiner that is substantially opposite to said first portion across said opening.

6. The line connector according to claim 1, wherein said control unit is further operable to:

store a table of expected mating component response signals for said at least one sensor, wherein each expected mating component response signal is associated with an expected modification of the electromagnetic field induced by the presence of a corresponding one of a plurality of types of the mating component extending through said opening; and compare the detected modification of the electromagnetic field induced by the presence of the object as the response signal to said table to determine whether the response signal matches one of the expected mating component response signals, wherein the expected mating component response signal for each of the plurality of types of the mating component is based on a material from which each type is formed.

7. The line connector according to claim 1, wherein said control unit is further operable to:

store a table of expected environmental noise response signals for said at least one sensor, wherein each expected environmental noise response signal is associated with an expected modification of the electromagnetic field induced by the presence of one of a plurality of sources of environmental noise proximate said opening; and compare the detected modification of the electronic field induced by the presence of the object as the response signal to said table to determine whether the response signal matches one of the expected environmental noise response signals, wherein the plurality of sources of environmental noise includes at least one of a metal post and a guard rail.

8. The line connector according to claim 1, wherein said control unit is coupled to a cross-bar that extends across said opening.

9. The line connector according to claim 1, wherein said at least one sensor further comprises a sensor positioned proximate a gate portion of said carabiner, said control unit is further configured to determine whether said gate portion is in a locked configuration based on the detected modification of the electromagnetic field induced by said gate portion and detected by said at least one sensor.

10. A personal fall protection system comprising:

a harness;

at least one line element; and a plurality of line connectors configured to couple to mating components for connecting said harness, said at least one line element, and an anchor, at least one of said plurality of line connectors comprising:

a carabiner having a loop portion that at least partially defines an opening, said opening configured to receive one of said mating components for said harness, said mating component including at least one of a D-ring, an O-ring and a snap hook;

at least one sensor that comprises a coil disposed around said loop portion; and a control unit coupled to said at least one sensor, said control unit operable to:

send an excitation signal to said at least one sensor to cause said at least one sensor to generate an electromagnetic field in response to the excitation signal and to detect a modification of the electromagnetic field induced by the presence of an object as a response signal, wherein said control unit is configured to determine whether the presence of the object that induces the detected modification of the electromagnetic field is associated with said mating component extending through said opening, and to determine that said line connector is coupled to said mating component based on the detected modification of the electromagnetic field induced by said mating component and detected by said at least one sensor.

11. The personal fall protection system according to claim 10, wherein said control unit comprises a communication interface configured to communicate with one of a personal monitor and a workspace monitor.

12. The personal fall protection system according to claim 10, wherein said at least one sensor comprises a plurality of sensors, each said coil of said plurality of sensors located at a different position along said loop portion of said carabiner.

13. The personal fall protection system according to claim 12, wherein said plurality of sensors comprises a first sensor positioned along a first portion of said loop portion of said carabiner, and a second sensor positioned along a second portion of said loop portion of said carabiner that is substantially non-parallel to said first portion.

14. The personal fall protection system according to claim 12, wherein said plurality of sensors comprises a first sensor positioned along a first portion of said loop portion of said carabiner, and a third sensor positioned along a third portion of said loop portion of said carabiner that is substantially opposite to said first portion across said opening.

15. The personal fall protection system according to claim 10, wherein said control unit is further operable to:

store a table of expected mating component response signals for said at least one sensor, wherein each expected mating component response signal is associated with an expected modification of the electromagnetic field induced by the presence of a corresponding one of a plurality of types of said mating component extending through said opening; and compare the detected modification of the electromagnetic field induced by the presence of the object as the response signal to said table to determine whether the response signal matches one of the expected mating component response signals, wherein the expected mating component response signal for each of said plurality of types of said mating component is based on a material from which each said type is formed.

16. The personal fall protection system according to claim 10, wherein said control unit is further operable to:

store a table of expected environmental noise response signals for said at least one sensor, wherein each expected environmental noise response signal is associated with an expected modification of the electromagnetic field induced by the presence of one of a plurality of sources of environmental noise proximate said opening; and compare the detected modification of the electronic field induced by the presence of the object as the response signal to said table to determine whether the response signal matches one of the expected environmental noise response signals, wherein the plurality of sources of environmental noise includes at least one of a metal post and a guard rail.

17. The personal fall protection system according to claim 10, wherein said control unit is coupled to a cross-bar that extends across said opening.

18. A method of making the line connector of claim 1 for the personal fall protection system, said method comprising:

disposing the coil of the at least one sensor around the loop portion of the carabiner to form the line connector, wherein the loop portion of the carabiner at least partially defines the opening configured to receive the mating component of the personal fall protection system; and coupling the control unit to the at least one sensor, wherein the control unit is operable to:

send the excitation signal to the at least one sensor; and determine whether the line connector is coupled to the mating component based on the response signal received from the at least one sensor.

19. The method according to claim 18, wherein the at least one sensor comprises a plurality of sensors, and disposing the coil around the loop portion comprises locating the coil of each respective sensor at a different position along the loop portion of the carabiner.

20. The method according to claim 19, wherein locating the coil of each respective sensor at a different position comprises:

positioning a first sensor along a first portion of the loop portion of the carabiner; and positioning a second sensor along a second portion of the loop portion of the carabiner that is substantially non-parallel to the first portion.

21. The method according to claim 19, wherein locating the coil of each respective sensor at a different position comprises:

positioning a first sensor along a first portion of the loop portion of the carabiner; and positioning a third sensor along a third portion of the loop portion of the carabiner that is substantially opposite to the first portion across the opening.

* * * * *